US012535217B2

(12) United States Patent
Meredith et al.

(10) Patent No.: US 12,535,217 B2
(45) Date of Patent: Jan. 27, 2026

(54) FIREPLACE RETROFIT CONSTRUCTION

(71) Applicant: Merediths', Inc., Richmond, IN (US)

(72) Inventors: John E. Meredith, Richmond, IN (US); Christopher C. Prior, Middle Grove, NY (US)

(73) Assignee: Merediths', Inc., Richmond, IN (US)

( * ) Notice: Subject to any disclaimer, the term of this patent is extended or adjusted under 35 U.S.C. 154(b) by 536 days.

(21) Appl. No.: 17/932,457

(22) Filed: Sep. 15, 2022

(65) Prior Publication Data

US 2023/0011450 A1 Jan. 12, 2023

Related U.S. Application Data

(63) Continuation of application No. 17/693,467, filed on Mar. 14, 2022, now abandoned.

(60) Provisional application No. 63/160,106, filed on Mar. 12, 2021.

(51) Int. Cl.
*F24B 1/195* (2006.01)
*F24B 1/189* (2006.01)

(52) U.S. Cl.
CPC ..... *F24B 1/195* (2013.01); *F24B 1/189* (2013.01)

(58) Field of Classification Search
CPC .. F24B 1/195; F24B 1/189; F24B 1/18; F24B 1/1804; F24B 1/1808; F24B 1/181
USPC ..... 126/500, 552
See application file for complete search history.

(56) References Cited

U.S. PATENT DOCUMENTS 3,826 A * 11/1844 Gilbert ..... F24B 1/18 126/500
272,013 A * 2/1883 Adair
2,435,172 A * 1/1948 Young ..... E04H 12/28 52/267
2,865,194 A * 12/1958 Wallace ..... E04F 13/0803 52/774
3,926,174 A * 12/1975 Bell ..... F24B 1/18 126/516
4,597,376 A * 7/1986 Gravier ..... F24B 1/24 126/400
6,029,654 A * 2/2000 Wade ..... F24B 1/18 126/529
6,286,502 B1 * 9/2001 Moberg ..... F24B 1/18 126/515
2001/0050078 A1 * 12/2001 Moberg ..... F24B 1/18 126/515
2004/0231250 A1 * 11/2004 Husted ..... F23M 5/04 52/27

(Continued)

*Primary Examiner* — Jorge A Pereiro
(74) *Attorney, Agent, or Firm* — Woodard, Emhardt, Henry, Reeves & Wagner, LLP

(57) ABSTRACT

A retrofit firebox assembly includes a frame, a floor, and sidewalls. The frame has a plurality of vertically extending spaced apart tube members to which solid masonry units are mounted. The back wall has a metal plenum member with a lower vertical portion, a lower angled portion, a central vertical portion, an upper angled portion, and an upper vertical portion, positioned to form a smooth, symmetrical bulge in the back wall extending into the firebox. The solid masonry units are positioned on their respective frame members using clips that position, align, and support the units. The metal plenum provides spaces for air to flow into the firebox between the lower vertical portion and the lower angled portion; and between the lower angled portion and the central vertical portion.

10 Claims, 13 Drawing Sheets

(56) References Cited

U.S. PATENT DOCUMENTS

2020/0048914 A1* 2/2020 Dickson ..... E04F 13/142

* cited by examiner

FIREPLACE RETROFIT CONSTRUCTION

REFERENCE TO RELATED APPLICATIONS

This application claims priority from U.S. patent application Ser. No. 17/693,467, filed Mar. 14, 2022, which claims the benefit of U.S. Provisional Patent Application No. 63/160,106, filed Mar. 12, 2021; and also claims priority from U.S. patent application Ser. No. 17/201,095, filed Mar. 15, 2021, which claims the benefit of U.S. Provisional Patent Application No. 62/989,049, filed Mar. 13, 2020; with the entire contents of all related applications being incorporated herein by reference.

FIELD OF THE INVENTION

The present invention relates generally to home fireplaces, and more particularly to a kit for installing a retrofit high-efficiency firebox in an existing fireplace space.

BACKGROUND TO THE INVENTION

Many homes are built with low-efficiency fireplaces, and it is often desirable to replace that existing low-efficiency fireplace with a higher-efficiency fireplace. When doing that, it would be desirable to provide a kit to enable the replacement to be done quickly and effectively, saving time and money and providing a superior installation.

A need therefore exists for a firebox retrofit kit for replacing a low-efficiency fireplace with a higher-efficiency fireplace in the existing fireplace space. The present invention addresses that need.

SUMMARY OF THE INVENTION

A firebox retrofit system, comprising:

1) a fireplace comprising a chimney, a flue, a lined rear wall, a pair of lined sidewalls, and a lined floor;
2) an assembled retrofit firebox assembly comprising:
   a) an assembled retrofit firebox assembly frame, wherein the retrofit firebox assembly frame comprises:
      i) a first sidewall frame assembly comprising a plurality of vertically extending tube members, with the tube members being spaced apart;
      ii) a second sidewall frame assembly comprising a plurality of vertically extending tube members, with the tube members being spaced apart;
      iii) a back wall metal plenum member comprising a metal sheet having a lower vertical portion, a lower angled portion extending forward into the firebox, a central vertical portion positioned forward of the plane of the lower vertical portion, an upper angled portion extending rearward from the plane of the central vertical portion, and an upper vertical portion positioned rearward of the plane of the central vertical portion, wherein the lower central angled portion, the central vertical portion, and the upper central angled portion combine to form a smooth, symmetrical bulge in the back wall extending into the firebox;
   b) a floor comprising solid masonry units;
   c) a first sidewall comprising a plurality of solid masonry units positioned on the first sidewall frame;
   d) a second sidewall comprising a plurality of solid masonry units positioned on the second sidewall frame;

e) a back wall comprising a plurality of solid masonry units positioned adjacent the back wall metal plenum member, but spaced apart from the back wall frame member to provide a back wall plenum effective to pass air behind the back wall solid masonry units; and
   f) an air duct (alternatively referred to as an airflow cassette or a bottom airflow cassette) adapted to receive air from the room in front of and below the firebox, and to pass that air rearward to the space between the back wall frame member and the solid masonry units positioned thereon.

In some embodiments the solid masonry units are positioned on their respective frame members using clips that position, align, and support the solid masonry units.

In some embodiments the lower angled portion of the rear wall is spaced slightly apart from the lower vertical portion to provide a space for air to flow into the firebox between the lower vertical portion and the lower angled portion; and wherein the central vertical portion of the rear wall is spaced slightly apart from the lower angled portion to provide a space for air to flow into the firebox between the lower angled portion and the central vertical portion; and wherein the upper angled portion of the rear wall is spaced slightly apart from the central vertical portion to provide a space for air to flow into the firebox between the central vertical portion and upper angled portion.

In some embodiments the clips that position, align, and support the solid masonry units include clips that maintain a gap of between ⅛" and ½" between adjacent solid masonry units on a wall.

In some embodiments the clips that position, align, and support the solid masonry units with respect to the back wall maintain a gap of between 1" and 4" between the solid masonry units and the frame, thus providing a plenum for air to flow between the solid masonry units and the back frame wall.

DESCRIPTION OF THE PREFERRED EMBODIMENTS

Figure 1:
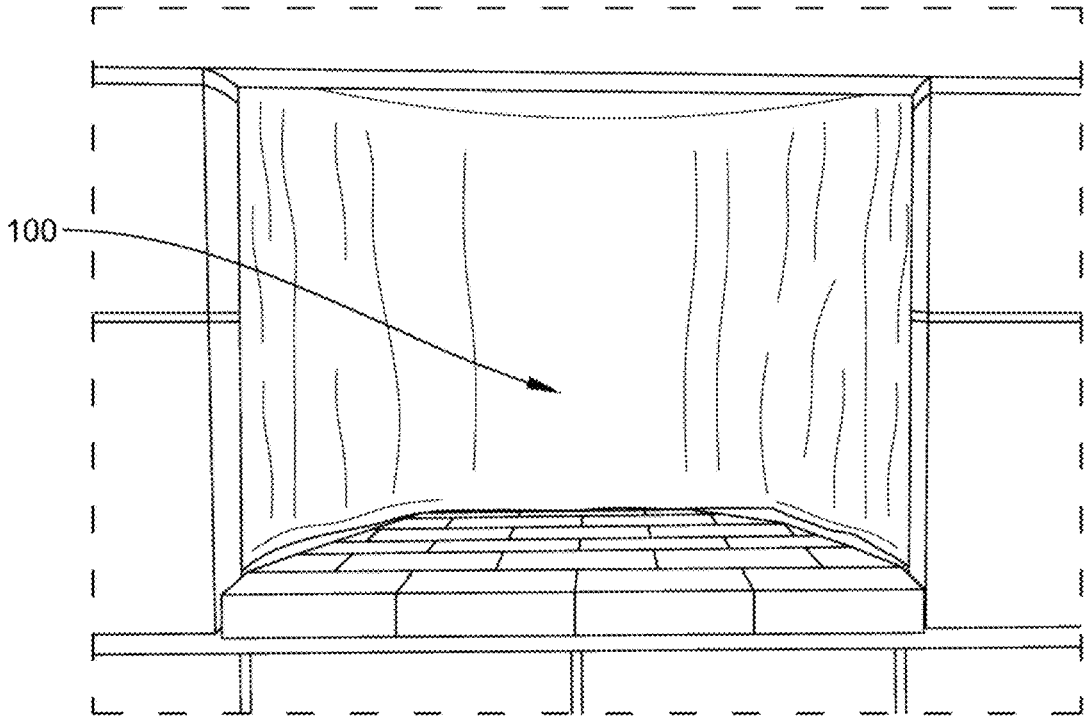
FIGS. 1-30 shows details regarding the construction of the inventive assembly.

For the purposes of promoting an understanding of the principles of the invention, reference will now be made to certain embodiments and specific language will be used to describe the same. It will nevertheless be understood that no limitation of the scope of the invention is thereby intended, with such alterations and modifications to the illustrated device being contemplated as would normally occur to one skilled in the art to which the invention relates.

As previously indicated, one aspect of the present invention provides a lab tested, field proven, engineered fireplace. Because of its unique shape, materials and air injection system, it produces more heat, less emissions and a tall "fun to watch" flame as it burns when compared to a traditional masonry fireplace. It also provides advantages with respect to assembly and retrofitting a firebox. In particular, the firebox retrofit kit is designed to improve, repair or restore existing masonry fireplaces. It can also be used for new construction masonry fireplaces.

The fireplace system should be installed by a fireplace professional in accordance with this installation and instruction manual. Do not use materials or parts other than those specified in these instructions.

Before installing the firebox retrofit kit into a masonry firebox, the firebox, smoke chamber and chimney flue must be thoroughly cleaned removing all soot, tar and glazed creosote. Thoroughly check the firebox, smoke chamber and chimney flue for any cracked, loose, or missing bricks, mortar or other materials and defects that could inhibit correct installation of this system.

The firebox retrofit kit is not intended to support the weight of the fireplace, chimney or chimney liner.

The firebox retrofit kit is UL listed at zero clearance to combustibles. The fireplace, floor, walls, hearth extension and smoke chamber must be constructed of a minimum of 4" nominal thickness of solid masonry units as per the Standard for Chimneys, Fireplaces, Vents and Solid Fuel-Burning Appliances, NFPA 211, (see 3.3.78); the International Residential Code (IRC); and the Uniform Mechanical Code (UMC) (hereinafter referred to collectively as "solid masonry units.")

The firebox retrofit kit retrofit system is intended to be used with any UL listed chimney lining system such as Stainless Steel flexible or ridged liners or any local code acceptable liners such as clay flue tile liners.

This unit requires a damper system. It is acceptable to install a UL listed top mounted cap/damper or other top sealing cap/damper that meets local codes.

Chimney liners and top sealing damper systems must be installed in accordance with manufacturers written installation instructions.

Step by Step Installation Instructions

Step 1

Determine if the firebox retrofit will fit into the existing fireplace and determine the type of smoke chamber to be installed. Determine whether the chimney be relined with a UL listed liner, or used with an existing clay flue liner.

Step 2

The smoke chamber and chimney liner must be cleaned and repaired before installing the firebox retrofit kit. To address the smoke chamber, refer to the instructions of your choice of a chimney cleaning or repair product or follow the instructions for using the firebox retrofit kit stainless steel smoke dome.

Step 3

After the smoke chamber and liner have been addressed, begin by preparing the existing masonry firebox. Remove the damper and back wall of the existing fireplace, preferably to the following range:

Depth—minimum 20"

Width—minimum 32", maximum 42"

Height—minimum 26", maximum 30"

Side walls may also be removed if needed.

Step 4

Begin with the ceramic wool and side trim pieces. The two stainless steel side trim channels are to be located on each of the firebox side walls just behind the face brick. The tabs with the mounting holes point to the back of the fireplace.

Attach the stainless steel side trim channels to the left and right side of the fireplace opening, just behind the backside of the face brick. Use 1¼×1¼ inch hex head masonry anchors or concrete screws, such as TAPCON® masonry anchors, at 2 or 3 points using a 3⁄16 drill and 5⁄16 drill/driver. Use a torpedo level to make sure each side trim piece is plumb. The distance from the face of the opening to the front of the side trim channel should measure the same on both the left and right sides of the opening.

Step 5

Figure 2:
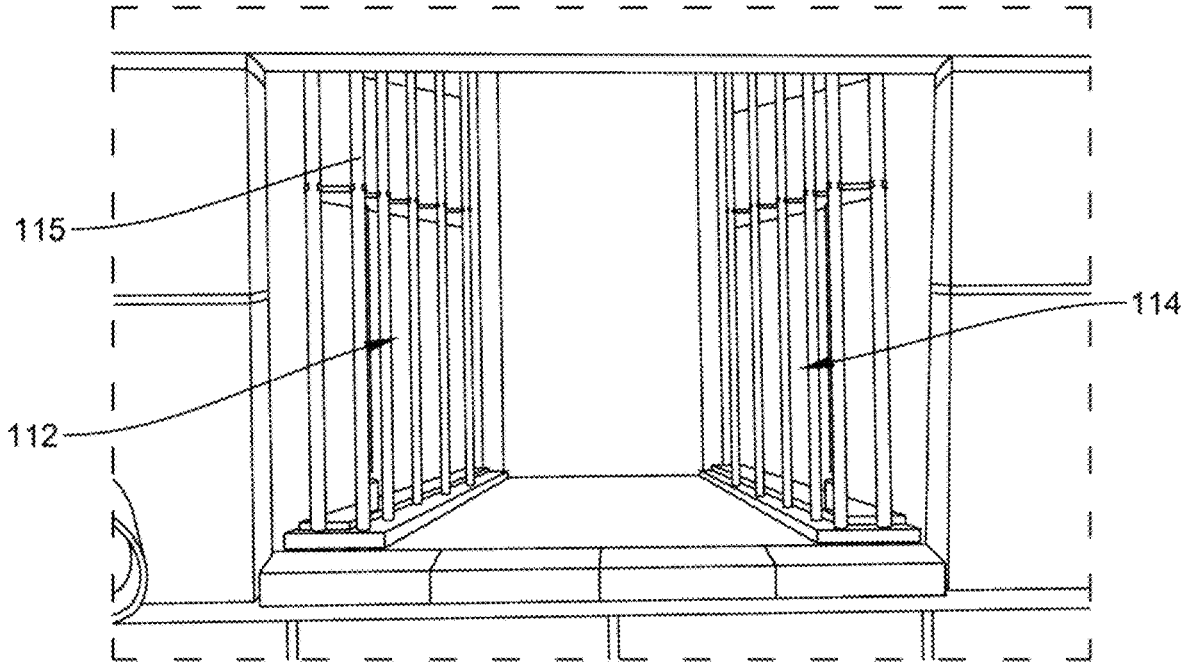

Starting at the backside of the side trim channels, measure the length of the two side walls and the back wall of the fireplace. Cut the 2" ceramic wool blanket to this length measurement. If needed, trim the ceramic blanket to the height needed. Cut the proper length long enough to line the existing firebox with a razor knife and secure with spray adhesive, as shown in FIG. 2. Thoroughly sweep or vacuum fireplace floor to remove any dust and debris.

Step 6

Remove the left and right side frames 112, 114 from Box 2. Then remove the back bottom cross brace 116 from Box 3 and the 12 clip retainer tubes 115 from Box 4.

Insert the clip retainer tubes 115 into the left and right side frames 112, 114 (6 each side).

Figure 3:
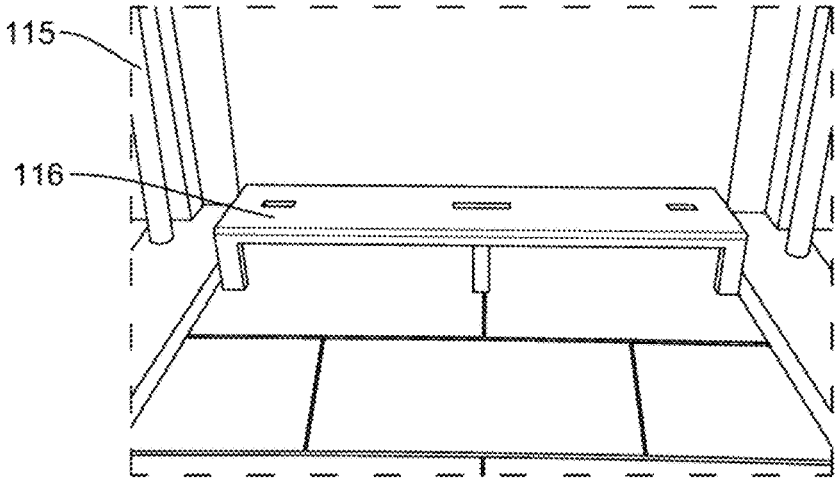

Insert the assembled side frames 112, 114 into the fireplace 100 and snap the bottom back cross brace 116 into position, as shown in FIGS. 2 and 3.

Figure 4:
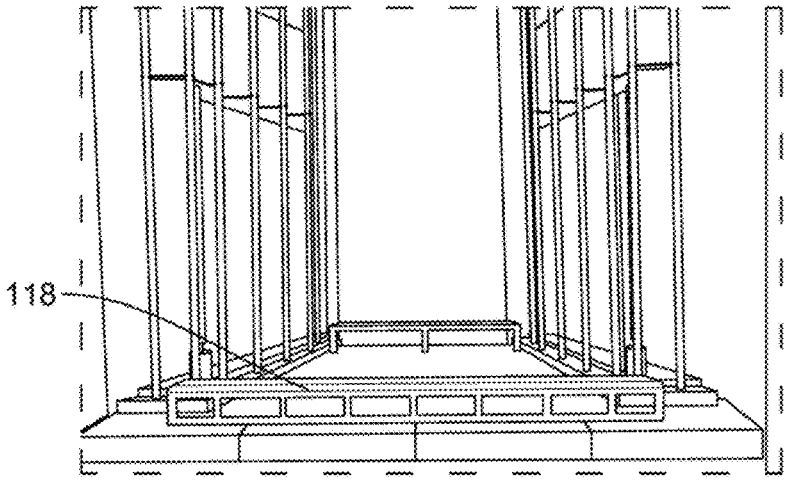
Figure 5:
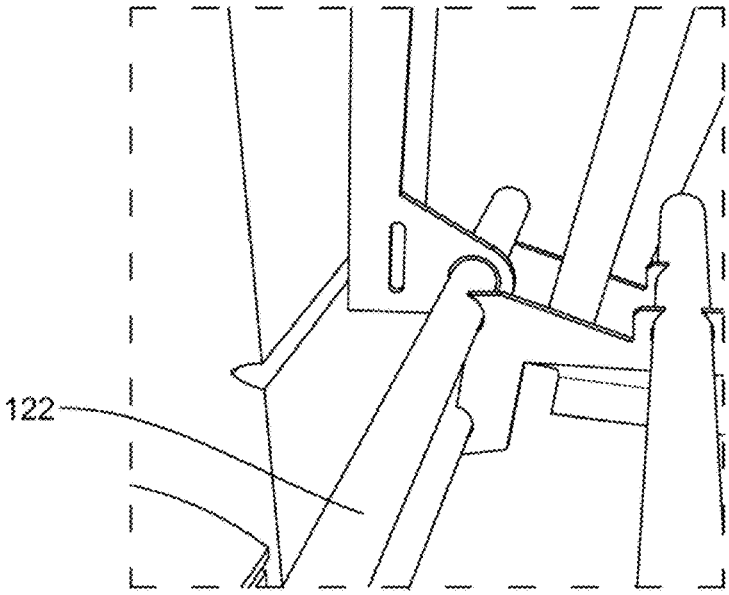

Temporarily attach the front bottom air inlet cross piece 118 into position, as shown in FIG. 4. Install lintel stabilizer bar 122, as shown in FIG. 5.

Step 7

Figure 6:
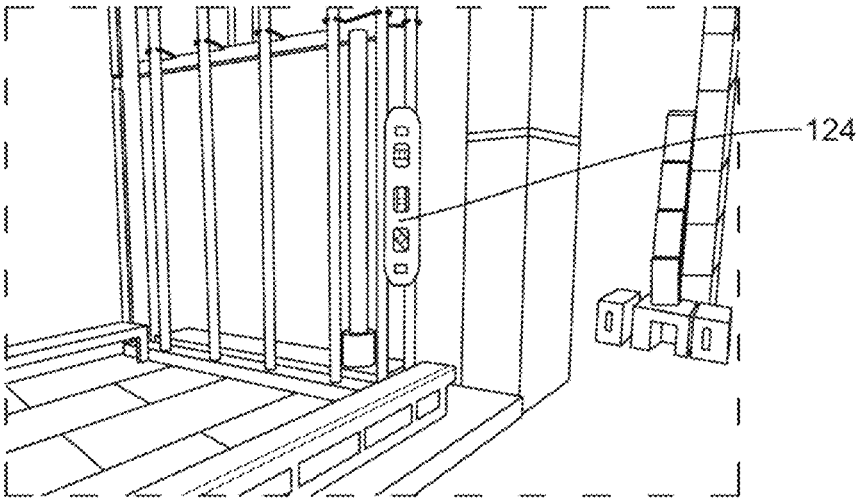
Figure 7:
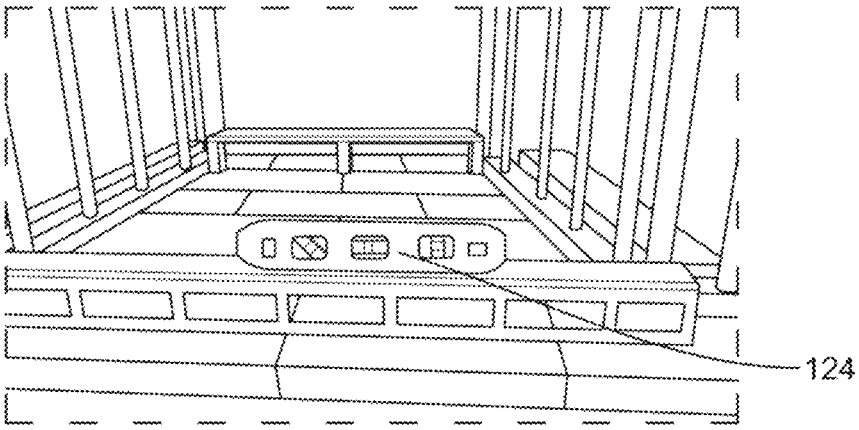

Position the whole assembly into position, moving it left, right, front, or back as needed, as shown in FIGS. 6 and 7. Use a torpedo level 124 to make sure the unit is level and plumb.

Step 8

Figure 8:
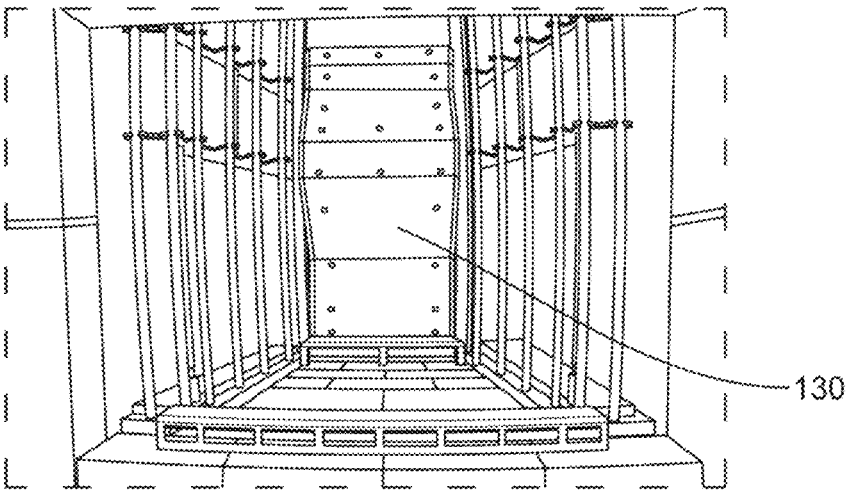

Install the back wall metal plenum member 130 so it snaps down into the slots on the rear side wall vertical channels, as shown in FIG. 8. There is a hand-hold slot on each side of the back wall metal plenum member to help you position it properly.

Figure 9:
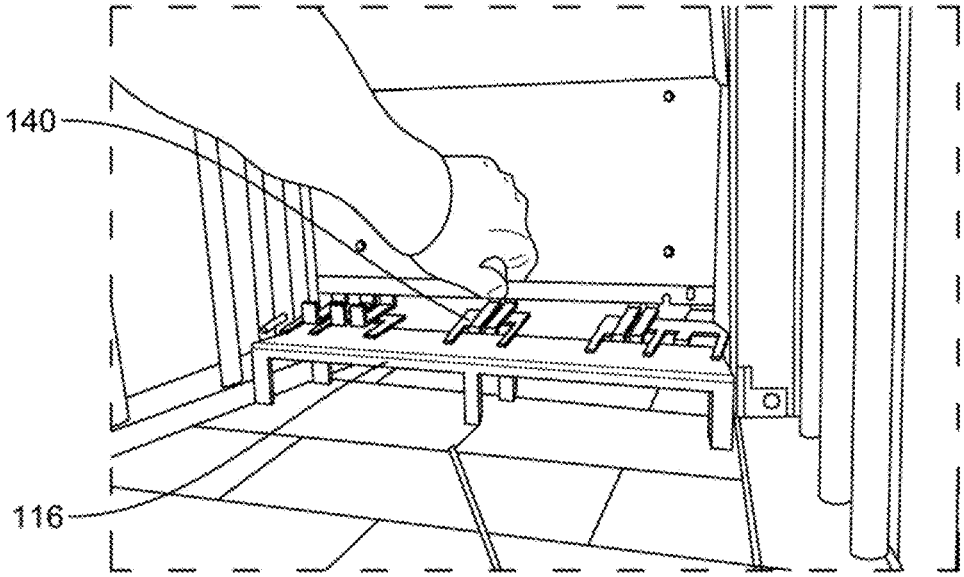
Figure 10:
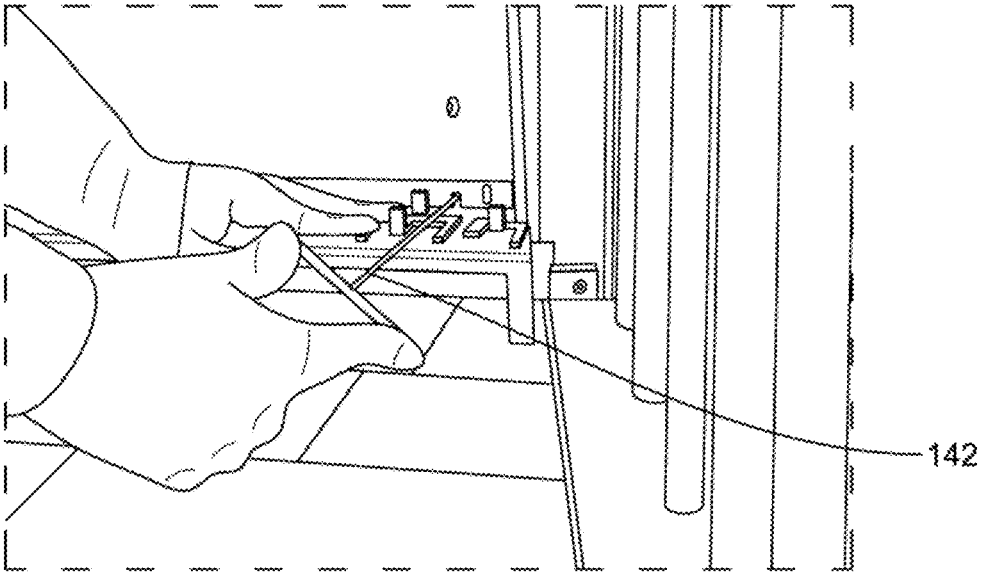

Slip an "A" clip 140 over the bottom set of cap bolts and slide it down so the prongs of the clip 140 engage in the slots on the back bottom brace, as shown in FIG. 9. Use the 9⁄16th T-wrench 142 to tighten cap bolts (do not over tighten), as shown in FIG. 10.

Step 9

Install the side wall 145 masonry units/bricks 146. The masonry units/bricks preferably include kerf cuts 147 along their sides to accept the retainer clips and drop pins used in the present invention, as illustrated in the drawings.

Start with either the left or right side. The masonry units/bricks for each side wall are marked by course number and position within each course.

Figure 11:
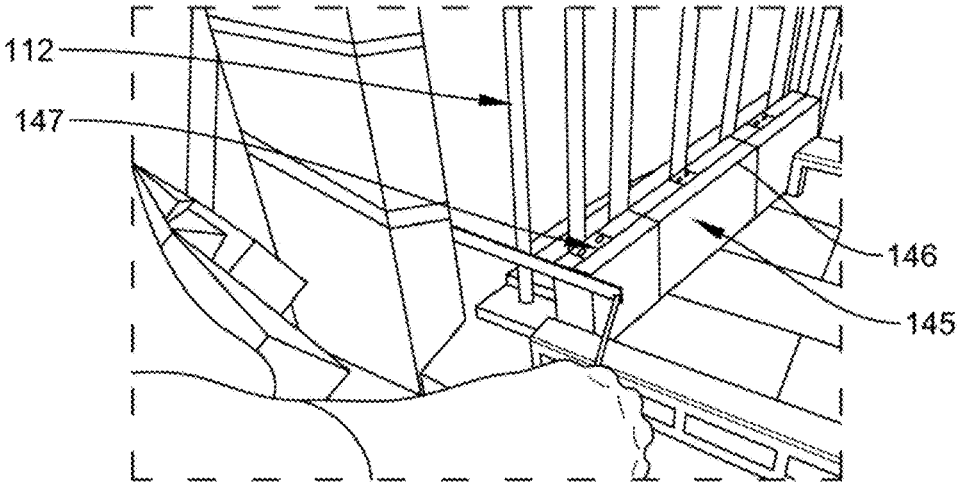
Figure 12:
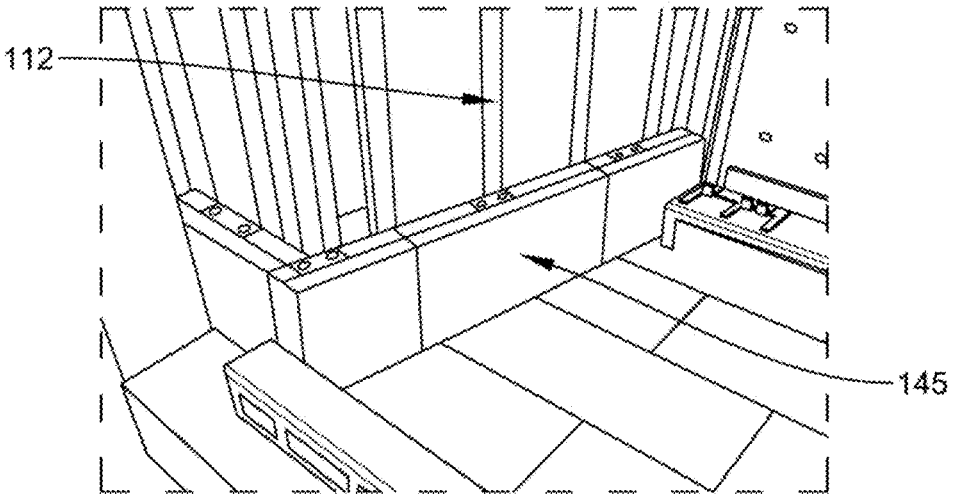

Set the first course of brick into the bottom channel on one of the sides, as shown in FIGS. 11 and 12. At the front of each course, measure the length of the face return brick, mark and cut as necessary so it fits inside the vertical side trim channel.

Using a fine tooth crosscut saw, cut the return brick for each course to proper length so it fits behind the reveal of the of the side trim channel.

To install the sidewall retainer clips, bend the head joint tab on the clip when it lines up with the head joint of the brick. If the head joint tab is over the center of a brick, do not bend the tab. To bend the head joint tabs on the clips, use the side notch on another clip to bend down 90°.

Figure 13:
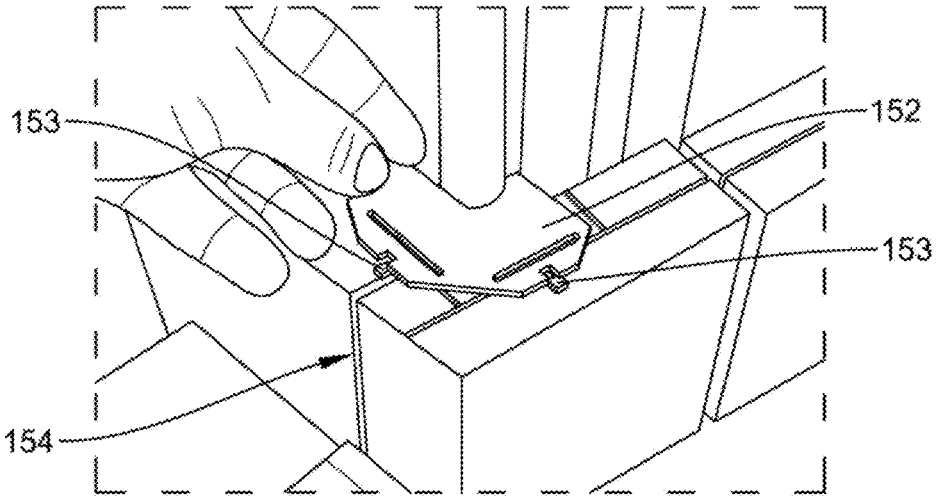

Start with the sidewall corner clip 152, as shown in FIG. 13. Bend down the tab 153 that lines up with the head joint 154 and then snap the clip onto the vertical pole.

Figure 14:
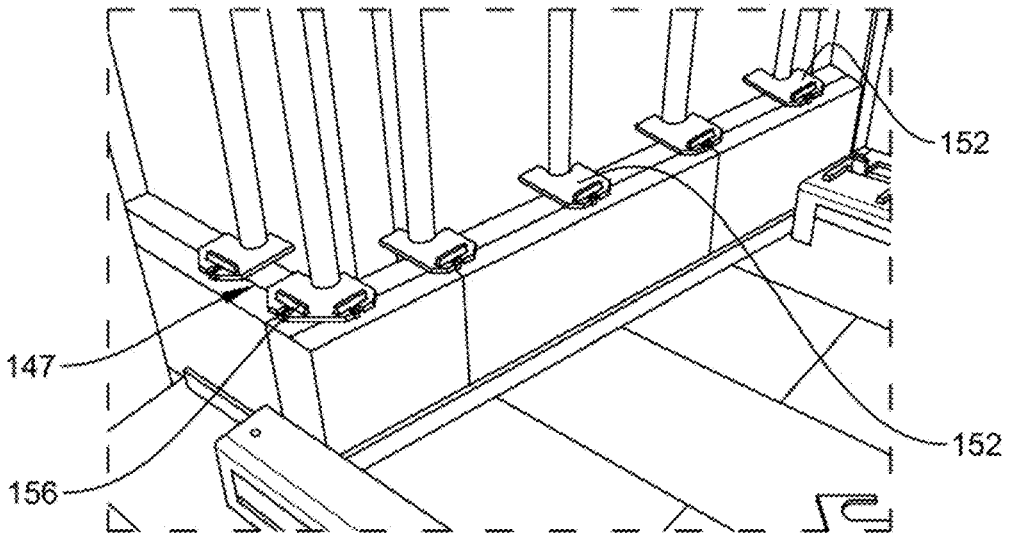

Then install the remaining sidewall clips 152 for the course you are on, bending down the tabs where necessary before snapping to the pole, as shown in FIG. 14. This clips the masonry units to the frame, and thus allows the frame to stabilize the masonry units.

Once the clips are in place, install the drop pins 156 into the kerf cuts 147 in the brick.

Figure 15:
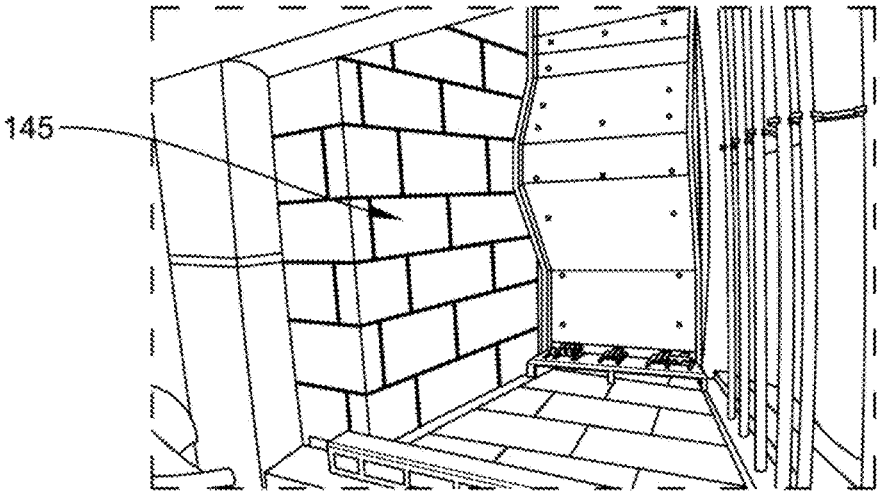

Repeat for each course until the first side is complete, as shown in FIG. 15.

Figure 16:
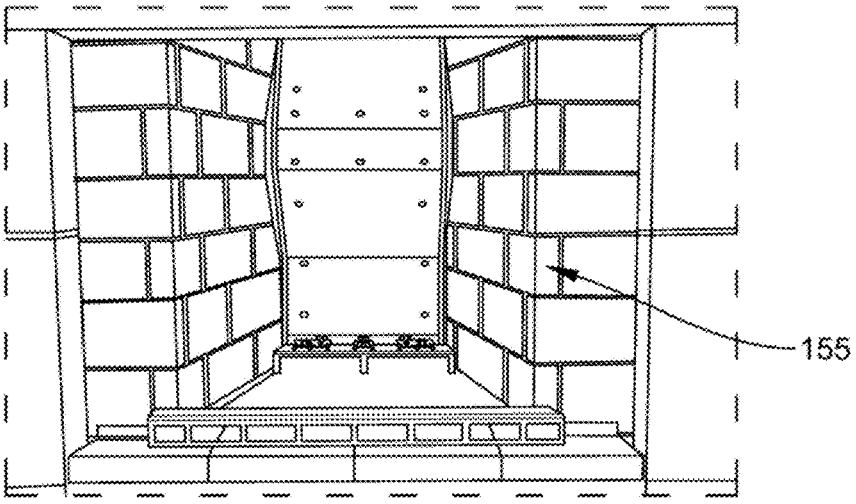

Then follow the same instructions for the other side using the properly marked brick, retention sidewall clips and drop pins, to provide the second wall 155 as shown in FIG. 16.

Note: Make sure the top of the 7th course (last course) also gets clips and drop pins.

Step 10

Grout the sidewall bricks. Mix the mortar. Using a 1-gallon clean mixing pail, place 10 cups (measuring cup supplied) of dry mortar into and add about 2¾ cups of water and mix. Add a few more ounces of water if needed to adjust mix to a creamy peanut butter like consistency suitable for grouting.

Thoroughly wet the side you are grouting with clean water and a sponge. Grout all the joints with mortar using a silicone faced margin trowel float. Thoroughly grout each joint by pushing mortar into each joint until full. Scrape off excess mortar with a margin trowel or putty knife, and then wash the face of the brick with clean water and a sponge. Rinse sponge frequently in clean water and wipe brick until the face of the brick look clean.

Step 11

Install back wall brick. In the preferred embodiments the back wall 160 of the unit is not grouted. The joints 164 are intentionally left open to provide pre-heated over-fire air for more complete combustion and reduced emissions.

First course: Start with the left brick 161 of the first course. Place the brick so the tabs of the clip slip into the bottom groove in the brick. Slide the left brick all the way to the left, repeat with the ride side brick 163. Then slide the center brick 162 onto the tabs of the clip.

Figure 17:
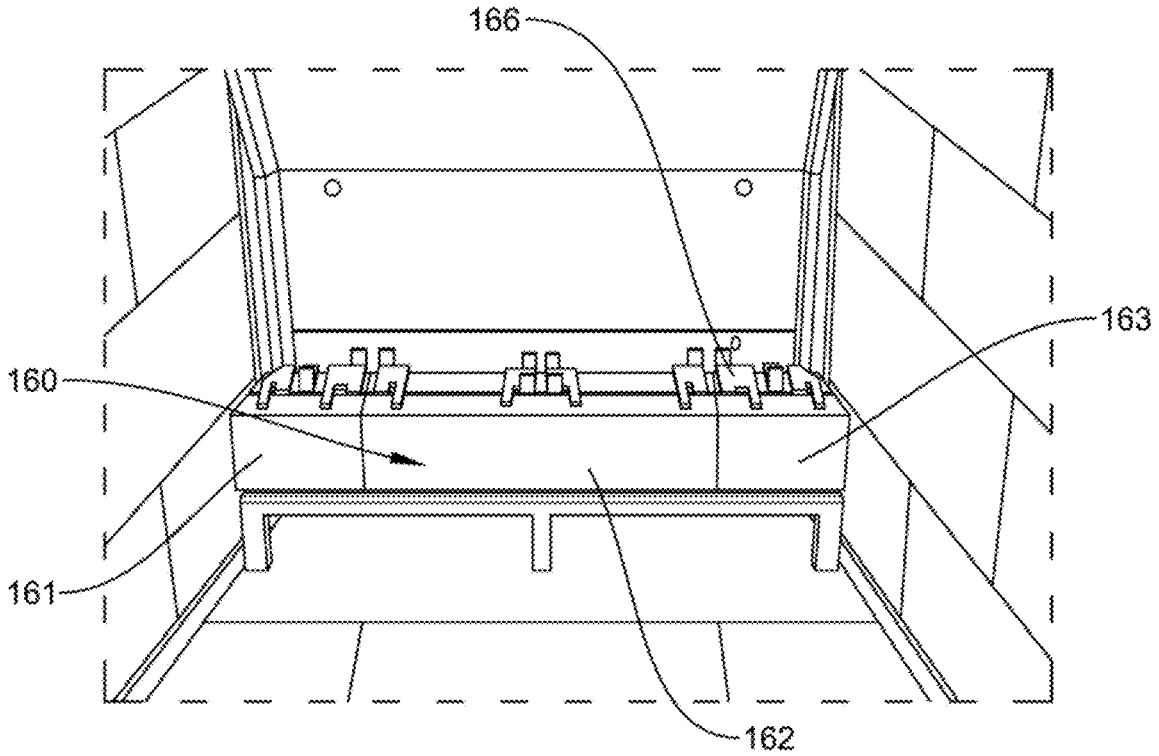

Next slide the "B" clip 166 over the back screws and onto the top of the first course until it lays flat on the top of the brick. Tighten the two nuts using the tee wrench to secure the "B" clip (do not over tighten). See FIG. 17.

Figure 18:
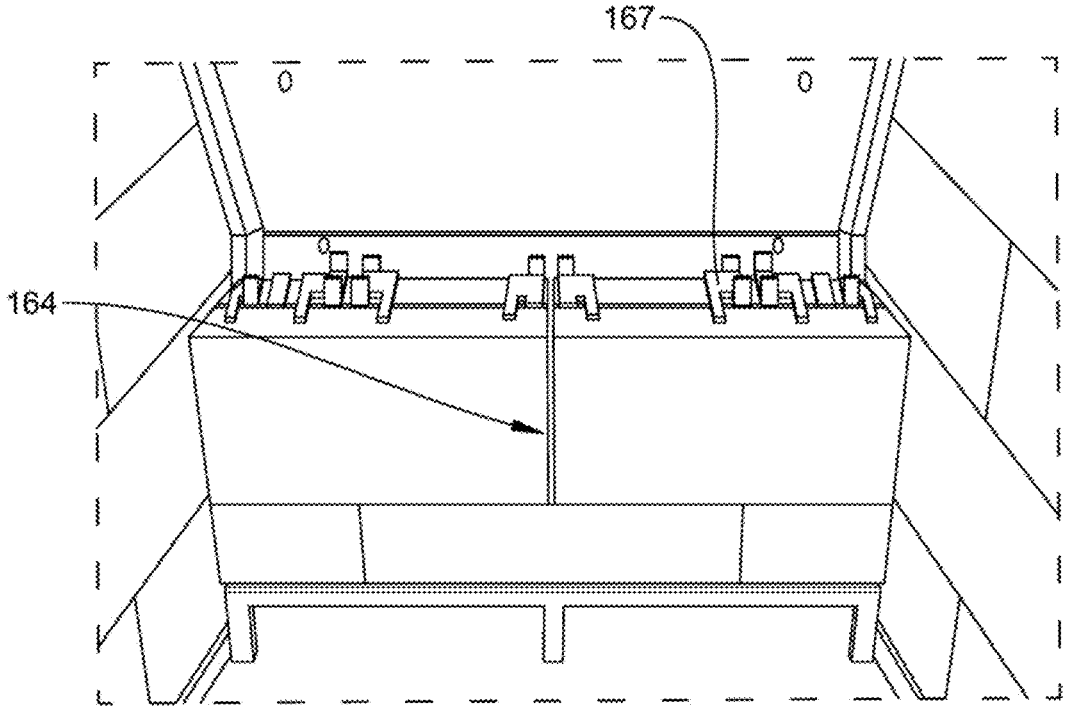

Second course: Place second course of brick onto the "B" clip, moving them left or right to get even head joint spacing, as shown in FIG. 18. Slip the "C" clip 167 over the back screws and onto the top of the second course until it lays flat. Tighten the three nuts using the tee wrench to secure the "C" clip (do not over tighten).

Figure 19:
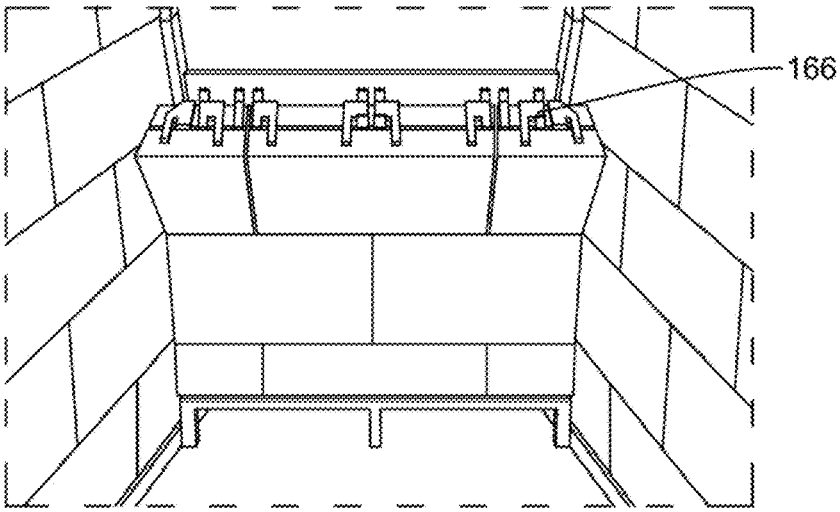

Third course: Place the third course of brick onto the "C" clip, moving them left or right to get even head joint spacing, as shown in FIG. 19. Slip a "B" clip 166 over the back screws and onto the top of the third course until it lays flat. Tighten the three nuts using the tee wrench to secure the "B" clip (do not over tighten).

Figure 20:
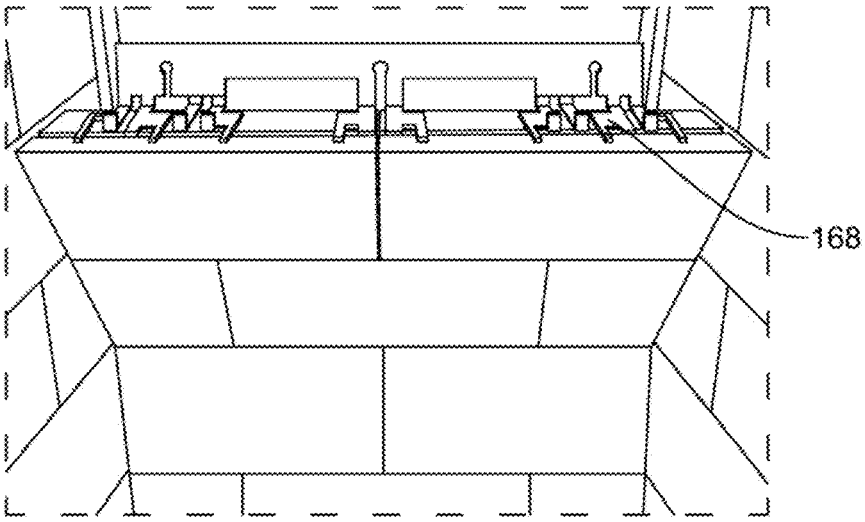

Fourth course: Place the fourth course of brick onto the "B" clip, moving them left or right to get even head joint spacing, as shown in FIG. 20. Slip a "D" clip 168 over the back screws and onto the top of the fourth course until it lays flat. Tighten the three nuts using the tee wrench to secure the "D" clip (do not over tighten).

Figure 21:
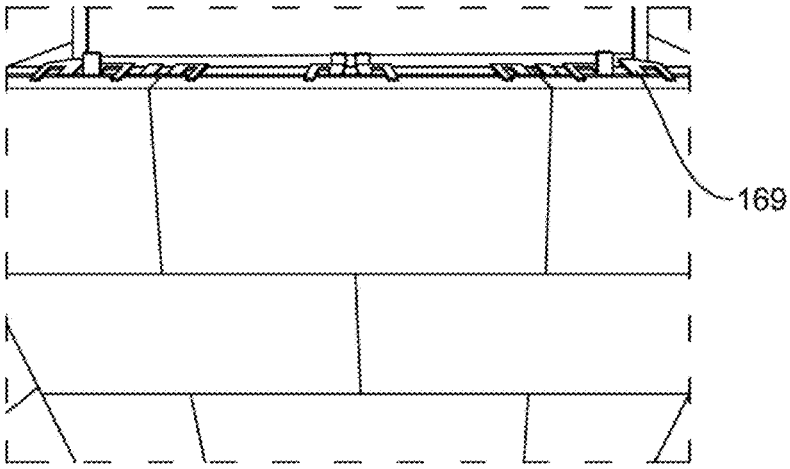

Fifth course: Place the fifth course of brick onto the "D" clip, moving them left or right to get even head joint spacing, as shown in FIG. 21. Slip the "E" or "F" clip 169 over the back screws and onto the top of the third course until it lays flat. Tighten the three nuts using the tee wrench to secure the clip.

Figure 22:
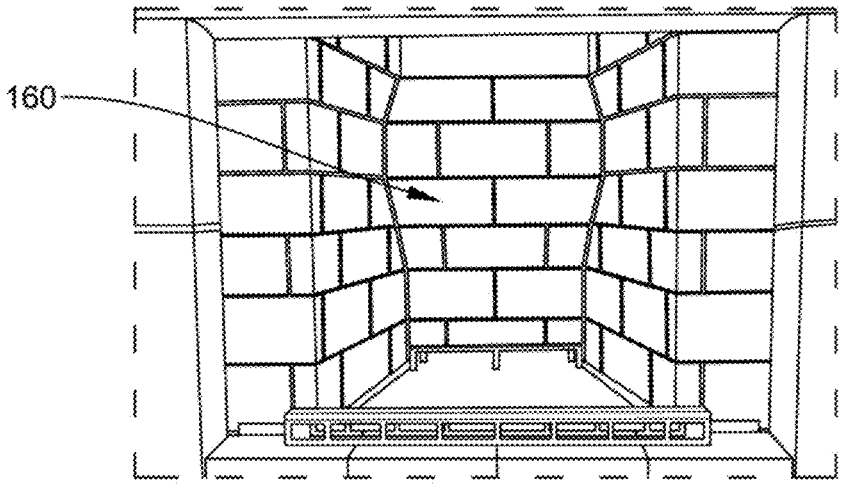

Sixth course: Place the sixth course of brick onto the clip, moving them left or right to get even head joint spacing, as shown in FIG. 22. Slip an "A" clip over the back screws and onto the top of the fifth course until it lays flat. Tighten the three nuts using the tee wrench to secure the "A" clip (do not over tighten).

Seventh course: Place the seventh course of brick onto the "A" clip, moving them left or right to get even had joint spacing. Slip a "B" clip over the back screws and onto the top of the third course until it lays flat. Tighten the three nuts using the tee wrench to secure the "B" clip (do not over tighten). Do not grout the back wall.

Step 12

Next place top gasket over the top of the last B clip.

Step 13

Figure 23:
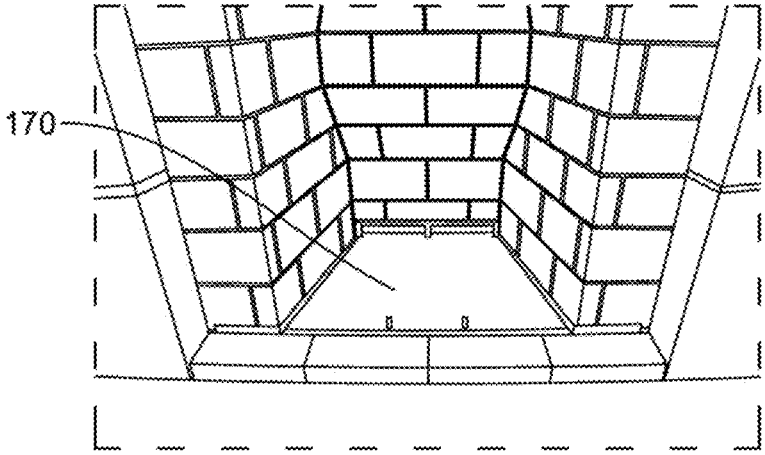

After the back and side walls have been assembled, remove front bottom air inlet cross piece 118. Set the bottom of the floor cassette 170 in place with the insulation side down, as shown in FIG. 23.

Figure 24:
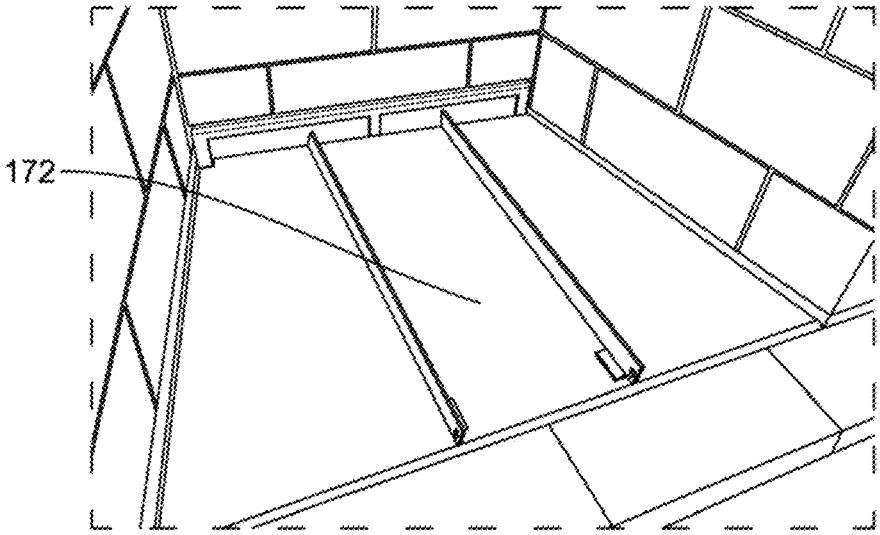

Then install the center floor channel by inserting the tabs 172 into the slits on the bottom floor with the holes at the front, as shown in FIG. 24.

Step 14

Figure 25:
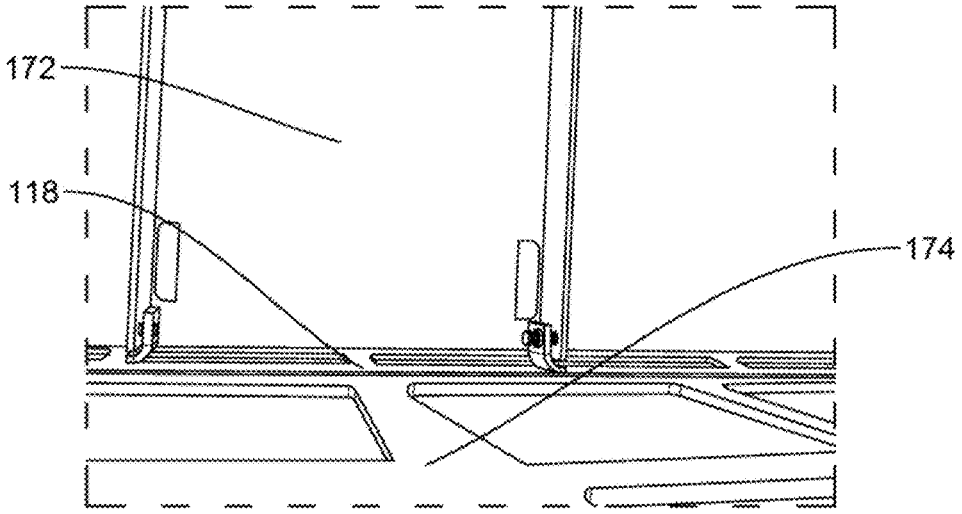

Attach the bottom air inlet cross piece 118 onto the front heat dam 174 using the included nuts. Then attach the assembled heat dam to the center floor channel and the side frames, as shown in FIG. 25.

Using a nut driver and a 9/64" Allen wrench attach the completed heat dam to the bottom of the air cassette.

Step 15

Figure 26:
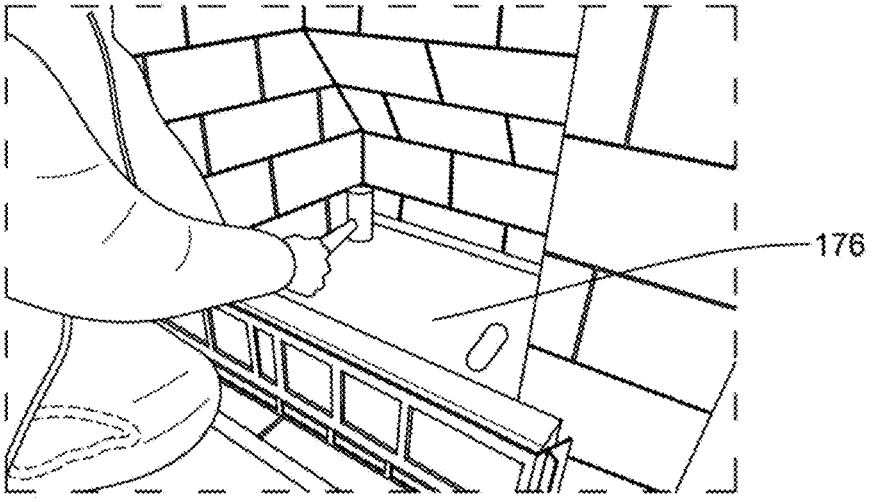

Install the top of the air cassette 176. Set in place by using the hand holds and place on top of the bottom of the air cassette, making sure it is seated properly, locked in place and level. Use a dead blow hammer to gently tap into place if necessary, as shown in FIG. 26.

Step 16

Figure 27:
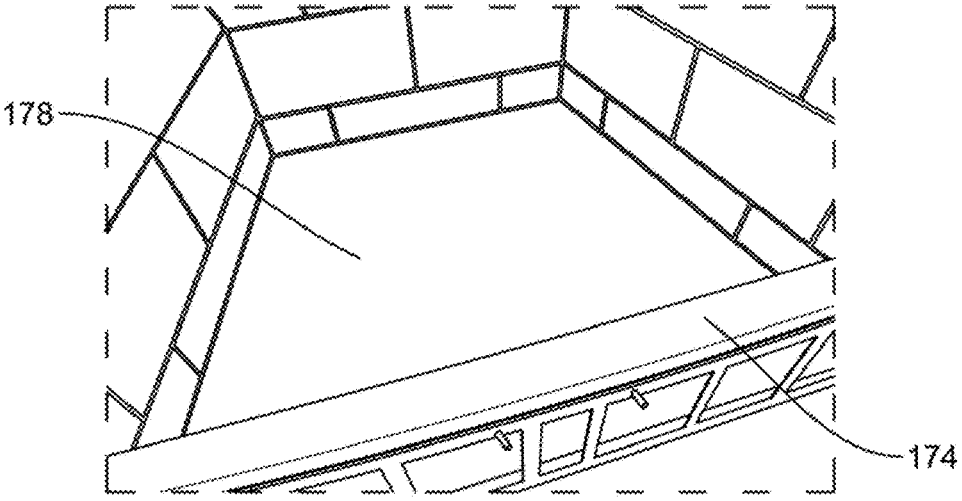

Place the two precut layers of ⅜" ceramic paper 178 over the top of the cassette, as shown in FIG. 27.

Step 17

Figure 28:
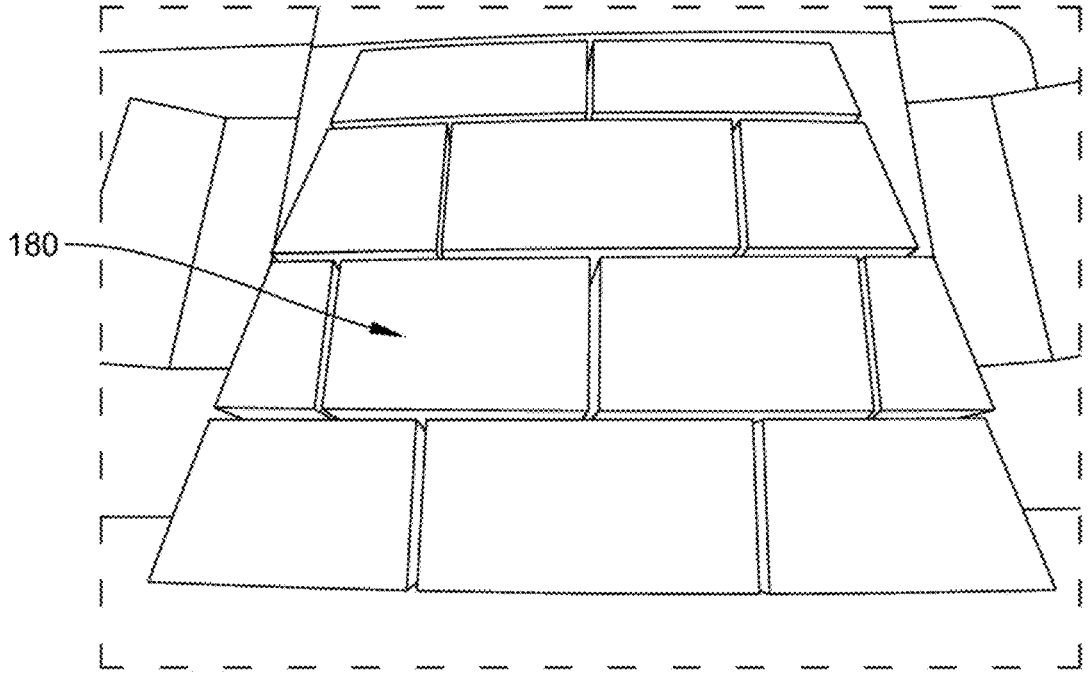
Figure 29:
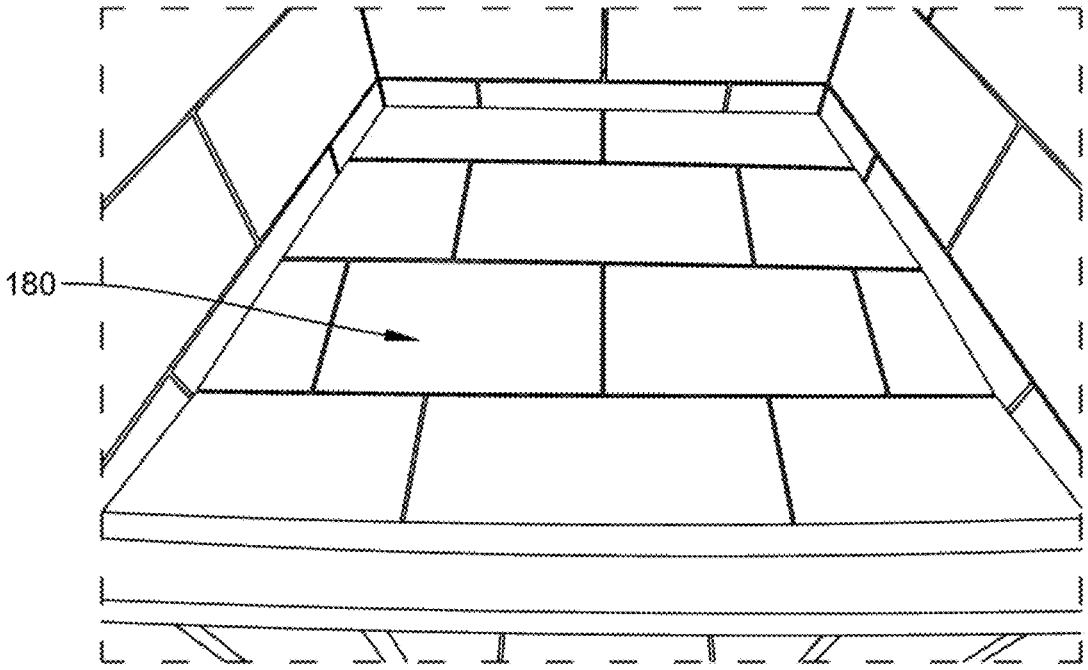

Lay floor brick 180, as shown in FIGS. 28 and 29.

Floor brick 180 are to be laid in dry. They are not mortared in place.

The position of the floor brick is marked on the bottom side of the brick. Lay the floor brick directly on the ceramic paper according to the diagram, starting with the back course. The completed floor brick should fit tightly inside the unit.

Step 18

Figure 30:
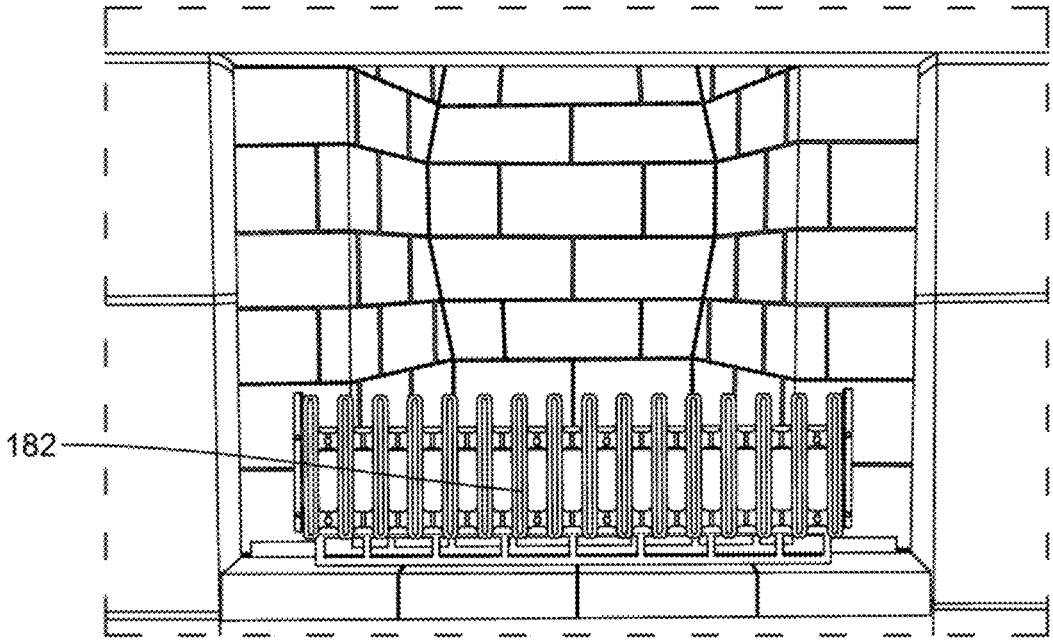

Attach the cast iron log retainer 182, as shown in FIG. 30.

The cast iron log retainer grill is cast in 4 pieces: 1 short left side piece, 1 long left side piece, 1 short right side piece, and 1 long right side piece.

Attach either short side piece then the corresponding longer front piece using washers and acorn nuts, and tighten with a nut driver.

Figure 31:
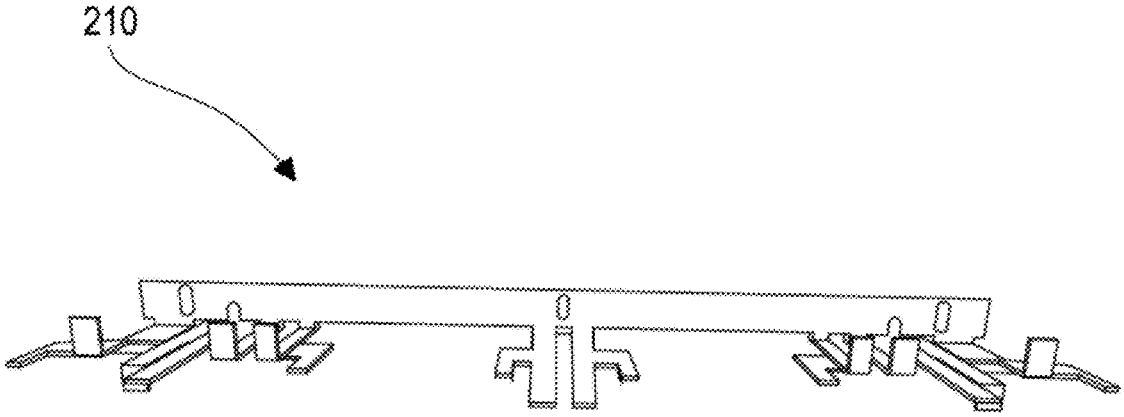
FIG. 31 shows one embodiments of a clip used to clip solid masonry units to the back wall metal plenum member.

FIG. 31 shows one embodiments of a clip 210 used to clip solid masonry units to the back wall metal plenum member.

Figure 32:
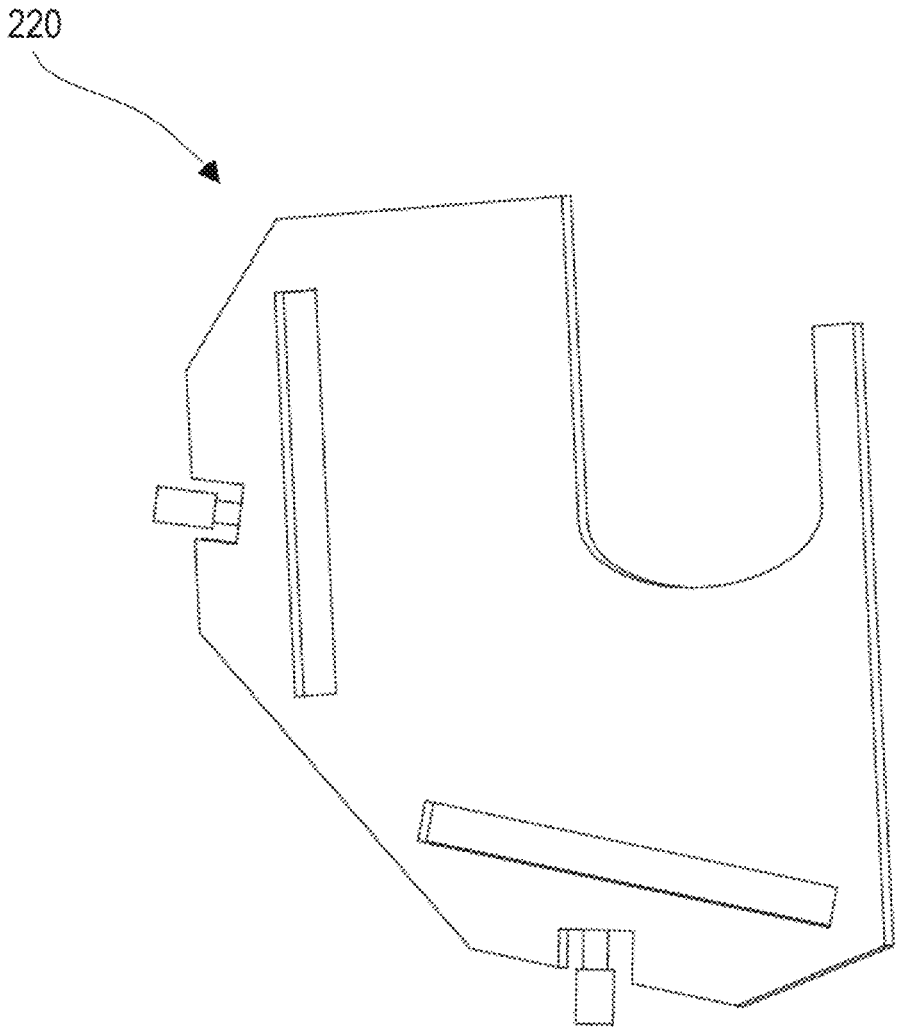
FIG. 32 shows one embodiments of a clip used to clip solid masonry units to the side wall frame members.

FIG. 32 shows one embodiments of a clip 220 used to clip solid masonry units to the side wall frame members.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the illustrated or described elements. Additionally, any or all of the features, elements, and/or embodiments disclosed herein may be combined with any or all of the other features, elements, and/or embodiments disclosed herein to provide a system or method that comprises or consists essentially of such features, elements, and/or embodiments.

The phrase A "and/or" B is used in this disclosure to mean A alone, or B alone, or both A and B.

Finally, as previously stated, this application claims priority from U.S. patent application Ser. No. 17/693,467, filed Mar. 14, 2022, which claims the benefit of U.S. Provisional Patent Application No. 63/160,106, filed Mar. 12, 2021. This application also claims priority from U.S. patent application Ser. No. 17/201,095, filed Mar. 15, 2021, which claims the benefit of U.S. Provisional Patent Application No. 62/989,049, filed Mar. 13, 2020. The entire contents of all of those applications is hereby incorporated herein by reference.

The invention claimed is:

1. A firebox retrofit assembly configured to be assembled in a fireplace comprising a chimney, a flue, a lined rear wall, a pair of lined sidewalls, and a lined floor, the firebox retrofit assembly comprising:

a) an assembled retrofit firebox assembly frame, wherein the retrofit firebox assembly frame comprises:
   i) a first sidewall frame assembly comprising a plurality of vertically extending tube members, with the tube members being spaced apart;
   ii) a second sidewall frame assembly comprising a plurality of vertically extending tube members, with the tube members being spaced apart;
   iii) a back wall metal plenum member comprising a metal sheet having a lower vertical portion, a lower angled portion extending forward into the firebox, a central vertical portion positioned forward of the plane of the lower vertical portion, an upper angled portion extending rearward from the plane of the central vertical portion, and an upper vertical portion positioned rearward of the plane of the central vertical portion, wherein the lower central angled portion, the central vertical portion, and the upper central angled portion combine to form a smooth, symmetrical bulge in the back wall extending into the firebox;

b) a floor comprising solid masonry units;

c) a first sidewall comprising a plurality of solid masonry units positioned interiorly of the first sidewall frame;

d) a second sidewall comprising a plurality of solid masonry units positioned interiorly of the second sidewall frame;

e) a back wall comprising a plurality of solid masonry units positioned adjacent the back wall metal plenum member, but spaced apart from the back wall metal plenum member to provide an air gap between the back wall masonry units and the back wall metal plenum member effective to allow air to flow between the masonry units and the back wall metal plenum member; and f) an air duct adapted to receive air from the room in front of and below the firebox, and to pass that air rearward into the air gap between the back wall frame member and the solid masonry units positioned thereon.

2. The firebox retrofit system of claim 1 wherein the solid masonry units are positioned on their respective frame members using clips that position, align, and support the solid masonry units.

3. The firebox retrofit system of claim 1 wherein the lower angled portion of the rear wall is spaced slightly apart from the lower vertical portion to provide a space for air to flow into the firebox between the lower vertical portion and the lower angled portion; and wherein the central vertical portion of the rear wall is spaced slightly apart from the lower angled portion to provide a space for air to flow into the firebox between the lower angled portion and the central vertical portion; and wherein the upper angled portion of the rear wall is spaced slightly apart from the central vertical portion to provide a space for air to flow into the firebox between the central vertical portion and upper angled portion.

4. The firebox retrofit system of claim 1 wherein the clips that position, align, and support the solid masonry units include clips that maintain a gap of between ⅛" and ½" between adjacent solid masonry units on a wall.

5. The firebox retrofit system of claim 1 wherein the clips that position, align, and support the solid masonry units with respect to the back wall maintain a gap of between 1" and 4" between the solid masonry units and the frame, thus providing a plenum for air to flow between the solid masonry units and the back frame wall.

6. A method for constructing a firebox retrofit system for a fireplace comprising a chimney, a flue, a lined rear wall, a pair of lined sidewalls, and a lined floor, the method comprising:

a) providing a kit for assembling a retrofit firebox assembly frame, wherein the retrofit firebox assembly frame comprises:
   i) a first sidewall frame assembly comprising a plurality of vertically extending tube members, with the tube members being spaced apart;
   ii) a second sidewall frame assembly comprising a plurality of vertically extending tube members, with the tube members being spaced apart;
   iii) a back wall metal plenum member comprising a metal sheet having a lower vertical portion, a lower angled portion extending forward into the firebox, a central vertical portion positioned forward of the plane of the lower vertical portion, an upper angled portion extending rearward from the plane of the central vertical portion, and an upper vertical portion positioned rearward of the plane of the central vertical portion, wherein the lower central angled portion, the central vertical portion, and the upper central angled portion combine to form a smooth, symmetrical bulge in the back wall extending into the firebox;

b) providing solid masonry units sized and adapted to build:
   i) a floor in the retrofit firebox assembly,
   ii) a first sidewall on the first sidewall frame,
   iii) a second sidewall on the second sidewall frame, and
   iv) a back wall adjacent the back wall metal plenum member, but spaced apart from the back wall metal plenum member to provide an air gap between the back wall masonry units and the back wall metal plenum member;

c) providing an air duct adapted to receive air from the room in front of and below the firebox, and to pass that air rearward into the air gap between the back wall metal plenum member and the solid masonry units positioned thereon;

d) assembling the retrofit firebox assembly frame;

e) mounting the solid masonry units on the assembled frame to construct a firebox retrofit system comprising:
   i) a firebox comprising:
      a) a solid floor;

b) side walls extending upward from the floor to a flue;

c) a rear wall having:

i) a lower vertical portion, ii) a lower angled portion extending forward into the firebox and spaced slightly apart from the lower vertical portion to provide a space for air to flow into the firebox between the lower vertical portion and the lower angled portion, iii) a central vertical portion positioned forward of the plane of the lower vertical portion and spaced slightly apart from the lower angled portion to provide a space for air to flow into the firebox between the lower angled portion and the central vertical portion, iv) an upper angled portion extending rearward from the plane of the central vertical portion, and spaced slightly apart from the central vertical portion to provide a space for air to flow into the firebox between the central vertical portion and upper angled portion, and v) an upper vertical portion positioned rearward of the plane of the central vertical portion, and optionally spaced slightly apart from the upper central angled portion to optionally provide a space for air to flow into the firebox between the upper vertical portion and upper angled portion, wherein the lower central angled portion, the central vertical portion, and the upper central angled portion combine to form a smooth, symmetrical bulge in the back wall extending into the firebox;

d) one or more air ducts effective to route air from the room to the space between the lower vertical portion and the lower angled portion, and from the room to the space between the lower angled portion and the central vertical portion;

e) an open front; and f) an open top effective for directing air and combustion gasses from the firebox to a flue.

7. The method of claim 6 wherein the solid masonry units are positioned on their respective frame members using clips that position, align, and support the solid masonry units.

8. The method of claim 6 wherein the lower angled portion of the rear wall is spaced slightly apart from the lower vertical portion to provide a space for air to flow into the firebox between the lower vertical portion and the lower angled portion; and wherein the central vertical portion of the rear wall is spaced slightly apart from the lower angled portion to provide a space for air to flow into the firebox between the lower angled portion and the central vertical portion; and wherein the upper angled portion of the rear wall is spaced slightly apart from the central vertical portion to provide a space for air to flow into the firebox between the central vertical portion and upper angled portion.

9. The method of claim 6 wherein the clips that position, align, and support the solid masonry units include clips that maintain a gap of between ⅛" and ½" between adjacent solid masonry units on a wall.

10. The method of claim 6 wherein the clips that position, align, and support the solid masonry units with respect to the back wall maintain a gap of between 1" and 4" between the solid masonry units and the frame, thus providing a plenum for air to flow between the solid masonry units and the back frame wall.

* * * * *